US007179142B2

(12) United States Patent
Fuse

(10) Patent No.: US 7,179,142 B2
(45) Date of Patent: Feb. 20, 2007

(54) MOUNTING STRUCTURE FOR JET PROPULSION PUMP IN PERSONAL WATERCRAFT

(75) Inventor: Tomohiro Fuse, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/995,522

(22) Filed: Nov. 24, 2004

(65) Prior Publication Data

US 2005/0148246 A1 Jul. 7, 2005

(30) Foreign Application Priority Data

Nov. 25, 2003 (JP) ..... 2003-394167

(51) Int. Cl.
*B63H 11/04* (2006.01)

(52) U.S. Cl. ..... 440/38; 114/55.5; 114/55.57

(58) Field of Classification Search ..... 440/38, 440/40–43, 111; 114/55.5–55.58
See application file for complete search history.

(56) References Cited

U.S. PATENT DOCUMENTS 5,234,364 A * 8/1993 Ito ..... 440/89 R
5,369,360 A * 11/1994 Amyot ..... 324/174
6,101,965 A * 8/2000 Koyanagi ..... 114/288
6,244,913 B1 * 6/2001 Matsumoto et al. ..... 440/38
2004/0185724 A1 * 9/2004 Korenjak et al. ..... 440/38

FOREIGN PATENT DOCUMENTS

JP 55-44068 * 3/1980
JP 2000-120589 4/2000
JP 2003-089399 3/2003

OTHER PUBLICATIONS

Translation of JP 55-044068.*

* cited by examiner

*Primary Examiner*—Sherman Basinger
(74) *Attorney, Agent, or Firm*—Westerman, Hattori, Daniels & Adrian, LLP.

(57) ABSTRACT

A mounting structure for mounting a jet propulsion pump in a body of a personal watercraft includes, a front mounting portion of the pump being mounted to a rear portion, in a planing direction of the watercraft body, and a ride plate mounted to the watercraft body, so as to be located beneath the pump, wherein the ride plate is mounted to watercraft body in at least two positions in the planing direction of the watercraft body. Further, an elastic member is disposed between the ride plate and the pump, such that a rear portion of the pump is supported by the ride plate through the elastic member.

19 Claims, 5 Drawing Sheets

MOUNTING STRUCTURE FOR JET PROPULSION PUMP IN PERSONAL WATERCRAFT

FIELD OF THE INVENTION

The present invention relates to a mounting structure for a jet propulsion pump in a personal watercraft.

RELATED ART

Conventionally, in a personal watercraft including a watercraft body, a jet propulsion pump is mounted to a rear portion, in the planing direction (the planing direction is the left-right direction in FIG. 3), of the watercraft body, and a ride plate is mounted to the watercraft body so as to be located beneath (on the lower side of) the jet propulsion pump. The jet propulsion pump has been mounted to the watercraft body by fastening a flange provided at a pump front mounting portion to the watercraft body by bolts For example, such is disclosed in the following: Japanese Patent Laid-Open No. 2003-89399, and Japanese Patent Laid-Open No. 2000-120589.

In the above-mentioned fixing structure for a jet propulsion pump, the jet propulsion pump has been mounted to the watercraft body by fastening the flange provided at a front portion of the jet propulsion pump to the watercraft body by bolts, so that the jet propulsion pump has been fixed to the watercraft body substantially in a cantilever condition.

On the other hand, since the ride plate is disposed beneath (or on the lower side of) the jet propulsion pump, it is considered that, when the flange at the front portion of the jet propulsion pump is fastened to the watercraft body by bolts and a rear portion of the jet propulsion pump is fixed through bolts or the like to the ride plate, which is firmly attached to the watercraft body, the jet propulsion pump can be firmly attached to the watercraft body (inclusive of the ride plate) in a both end supported condition.

However, in the case of such a structure, i.e., the structure in which the flange at a front portion of the jet propulsion pump is fastened to the watercraft body by bolts and a rear portion of the jet propulsion pump is fixed to the ride plate by bolts or the like, unless the jet propulsion pump flange portion mounting portion of the watercraft body, the jet propulsion pump and the ride plate are individually produced with high accuracy, the jet propulsion pump is not mounted in an appropriate position but is mounted in the state of being inclined relative to the appropriate position.

In practice, it is difficult to produce the above-mentioned three members individually with such high accuracy that all the jet propulsion pumps (for example, all lots of jet propulsion pumps) can be assuredly mounted in the appropriate position. Under such a situation, to mount the jet propulsion pump in the appropriate position, it is necessary to carry out the operation of fastening the jet propulsion pump in position by bolts while adjusting the mount position of the jet propulsion pump by interposing a shim or the like between the flange of the jet propulsion pump and the watercraft body and/or between the jet propulsion pump and the ride plate, and the operation would be highly complicated.

SUMMARY OF THE INVENTION

It is an object of the present invention to provide a mounting structure for a jet propulsion pump in a personal watercraft by which the jet propulsion pump can be mounted in an appropriate position, firmly and easily.

To attain the above object, according to the present invention, there is provided a mounting structure for mounting a jet propulsion pump in a body of a personal watercraft. The mounting structure includes a front mounting portion of the pump being mounted to a rear portion, in a planing direction, of the watercraft body, a ride plate mounted to the watercraft body, so as to be located beneath the pump, wherein the ride plate is mounted to watercraft body in at least two positions in the planning direction of the watercraft body, and an elastic member disposed between the ride plate and the pump, such that a rear portion of the pump is supported by the ride plate through the elastic member.

Incidentally, the expression "a rear portion of the jet propulsion pump" means a portion, on the rear side relative to the front portion, of the jet propulsion pump, the front portion being fixed to a rear portion, in the planing direction, of the watercraft body.

The mounting structure for a jet propulsion pump in a personal watercraft according to the present invention is a mounting structure for a jet propulsion pump in a personal watercraft including, a watercraft body, the jet propulsion pump of which a front portion is mounted to a rear portion, in the planing direction, of the watercraft body, and a ride plate fixed to the watercraft body so as to be located beneath the jet propulsion pump. The ride plate is fixed to the watercraft body in at least two positions in the planing direction of the watercraft body. Further, an elastic member is disposed between the ride plate and the jet propulsion pump, and a rear portion of the jet propulsion pump is supported by the ride plate through the elastic member. Therefore, the mounting structure described above provides the functions or effects described below.

Namely, the jet propulsion pump is firmly mounted to the watercraft body by a structure in which the front portion of the jet propulsion pump is mounted to the rear portion, in the planing direction, of the watercraft body, the rear portion of the jet propulsion pump is supported by the ride plate through the elastic member, and the ride plate is fixed to the watercraft body in at least two positions in the planing direction of the watercraft body. As a result, the jet propulsion pump is firmly mounted to the watercraft body in a both end supported condition.

In addition, the rear portion of the jet propulsion pump is not fixed to the ride plate by bolts or the like but is elastically supported through the elastic member, so that, if only the jet propulsion pump front portion mounting portion of the watercraft body and the front portion of the jet propulsion pump are produced with high accuracy, the jet propulsion pump will be mounted in an appropriate position. Therefore, there is no need for the above-mentioned adjusting operation using the shims or the like, and the jet propulsion pump can be easily mounted in the appropriate position.

Moreover, since the elastic member is interposed between the ride plate and the jet propulsion pump, it is possible to alleviate the influence, on the jet propulsion pump, of the shock due to vigorous collisions of water against the ride plate.

If the rear portion of the jet propulsion pump is fixed to the ride plate by bolts or the like as above-mentioned, the shock at the time of vigorous collisions of water against the ride plate would be exerted, nearly as it is, on the jet propulsion pump, causing bad effects on the durability of the jet propulsion pump, and the like. On the other hand, according to the structure of the present invention, notwithstanding the jet propulsion pump being supported by the ride plate, the shock at the time of vigorous collisions of water against the ride plate is alleviated before being transmitted to the jet propulsion pump, so that there is no possibility that the durability of the jet propulsion pump might be decreased.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
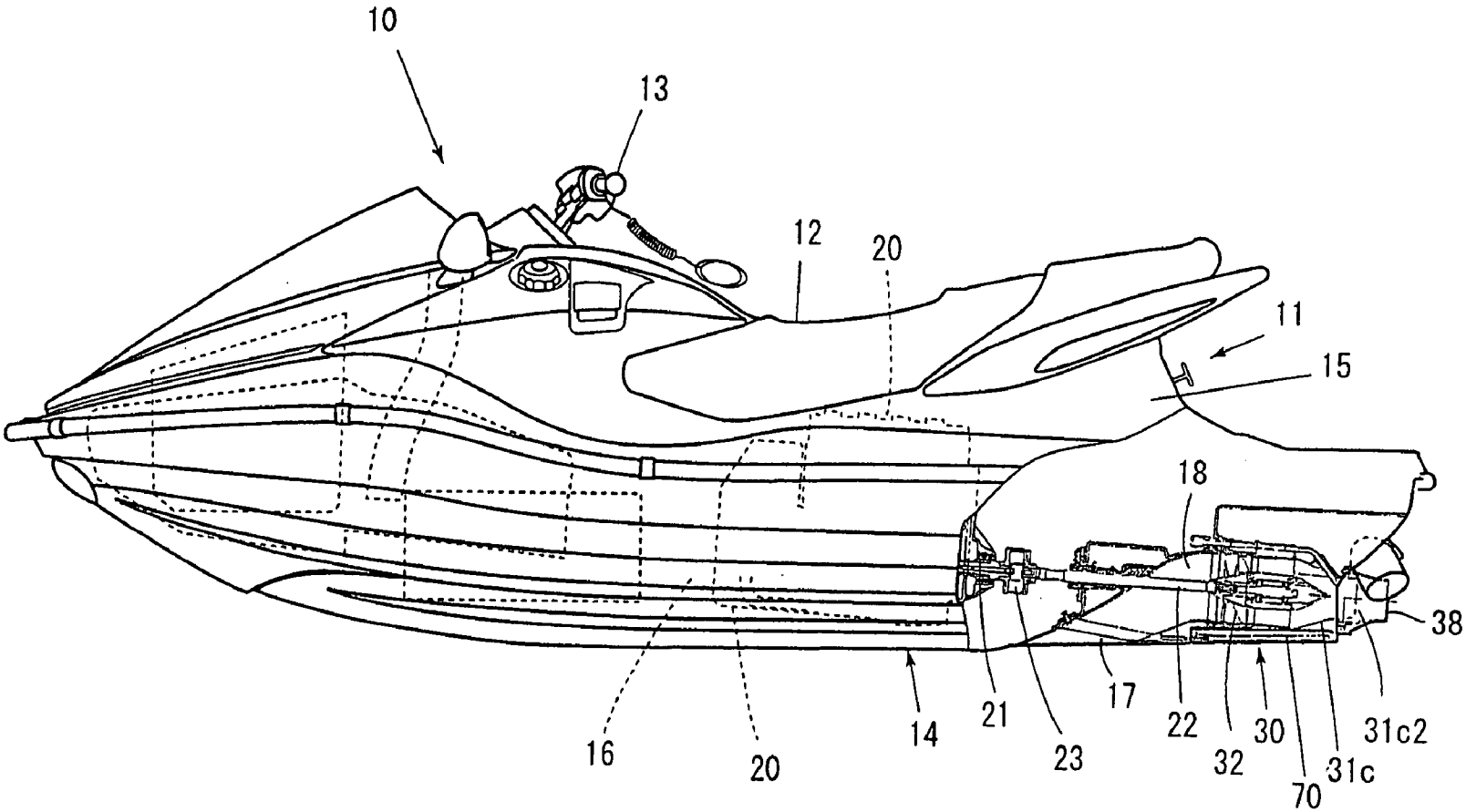
FIG. 1 is a partial cutaway general side view showing one example of a personal watercraft using an embodiment of a mounting structure for a jet propulsion pump in a personal watercraft according to the present invention.

An embodiment of the present invention will be described below referring to the drawings.

Figure 2:
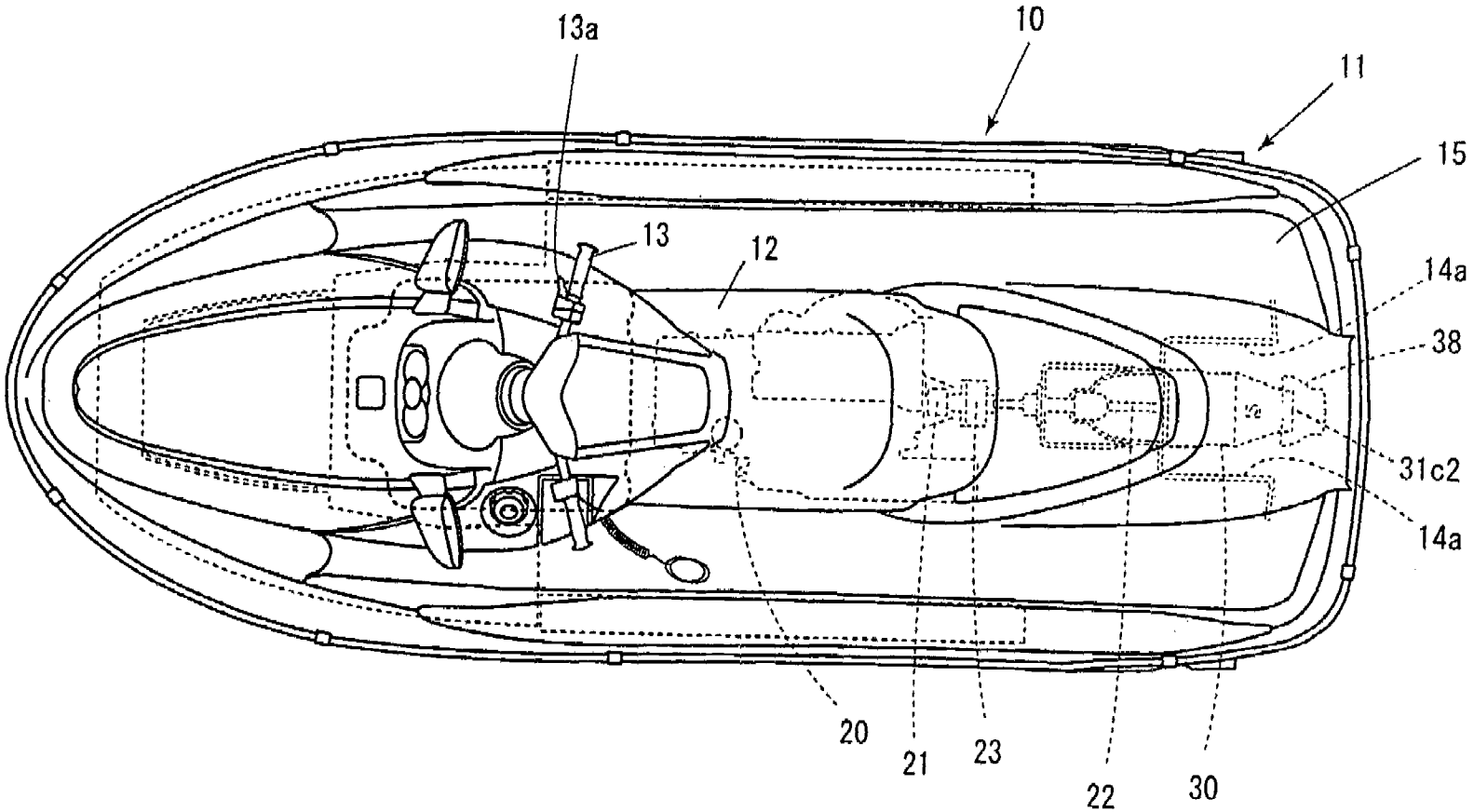
FIG. 2 is a general plan view of the same.

FIG. 1 is a partial cutaway general side view showing one example of a personal watercraft using an embodiment of the mounting structure for a jet propulsion pump in the personal watercraft, according to the present invention, and FIG. 2 is a general plan view of the same.

As shown in these figures (mainly in FIG. 1), the personal watercraft 10 is a saddle ride type personal watercraft, in which the rider is seated on a seat 12 on a watercraft body 11, and rudder-operating handle bars 13 with a throttle lever 13*a* are gripped by the rider's hands, whereby the personal watercraft 10 can be made to plane.

The watercraft body 11 has a float structure in which a hull 14 and a deck 15 are joined to each other to form a space 16 therein. In the space 16, an engine 20 is mounted on the hull 14, and a water jet pump (jet propulsion pump) 30, as a propelling means driven by the engine 20, is provided at a rear portion of the hull 14.

The jet propulsion pump 30 has an impeller 32 disposed in a flow passage 18 extending from a water intake port 17 opened in the bottom to a jet port 31*c*2 opened at the rear end of the watercraft body and to a deflector 38. A shaft (drive shaft) 22 for driving the impeller 32 is coupled to an output shaft 21 of the engine 20 through a coupler 23. Therefore, when the impeller 32 is driven to rotate by engine 20 through the coupler 23 and the drive shaft 22, water taken in via the water intake port 17 is jetted out from the jet port 31*c*2 and through the deflector 38, whereby the watercraft body 11 is propelled. The drive rotation speed of the engine 20, i.e., the propulsion force of the jet propulsion pump 30 is controlled by turning a throttle lever 13*a* (see FIG. 2) at the rudder-operating handle bars 13. The deflector 38 is connected to the rudder-operating handle bars 13 through an operating wire (not shown), and is turned by operating the handle bars 13, whereby the planing (or traveling) direction of the watercraft body 11 can be changed.

Figure 3:
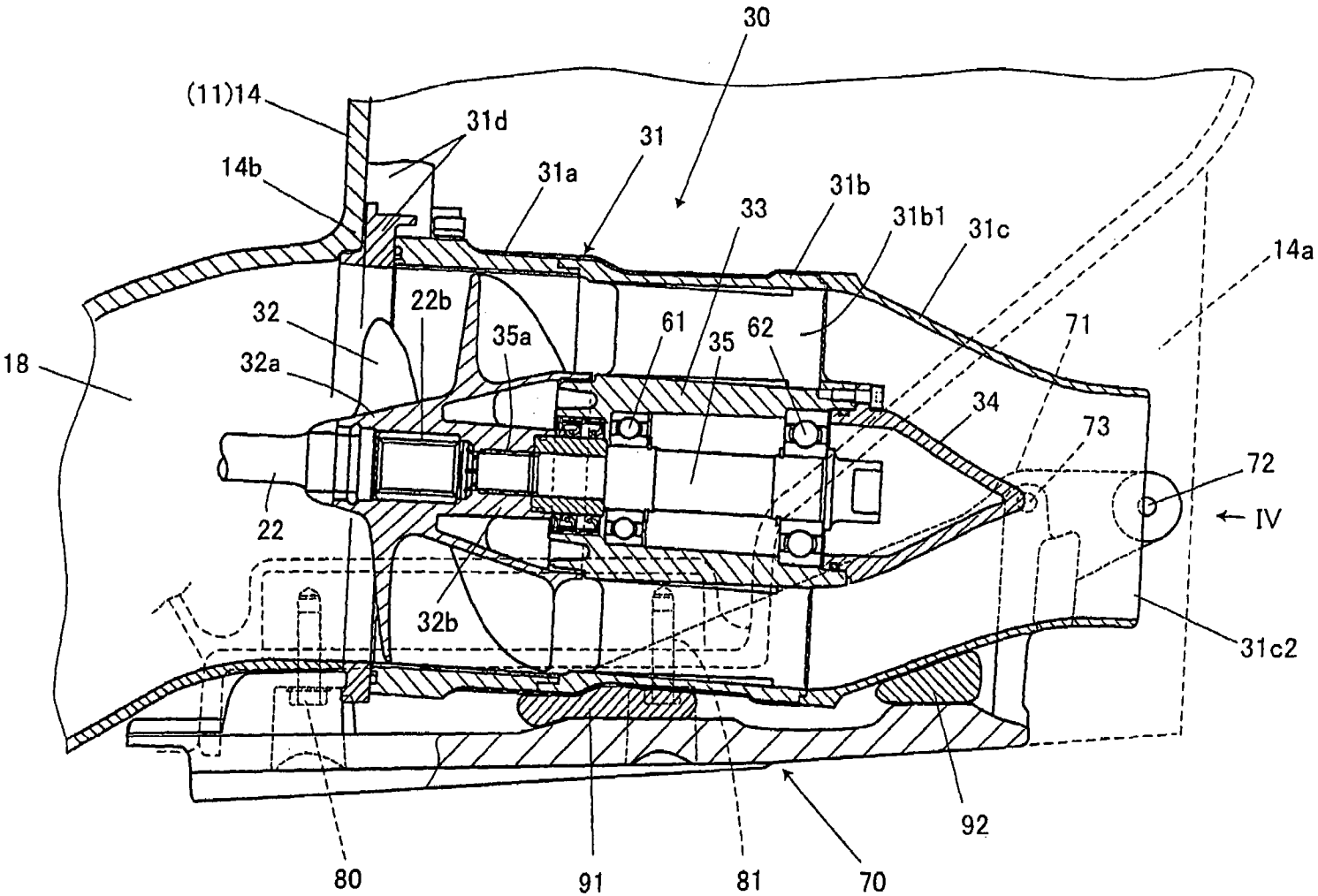
FIG. 3 is a cross-sectional view (partly omitted enlarged sectional view of FIG. 1) showing the mounting structure for the jet propulsion pump.
Figure 4:
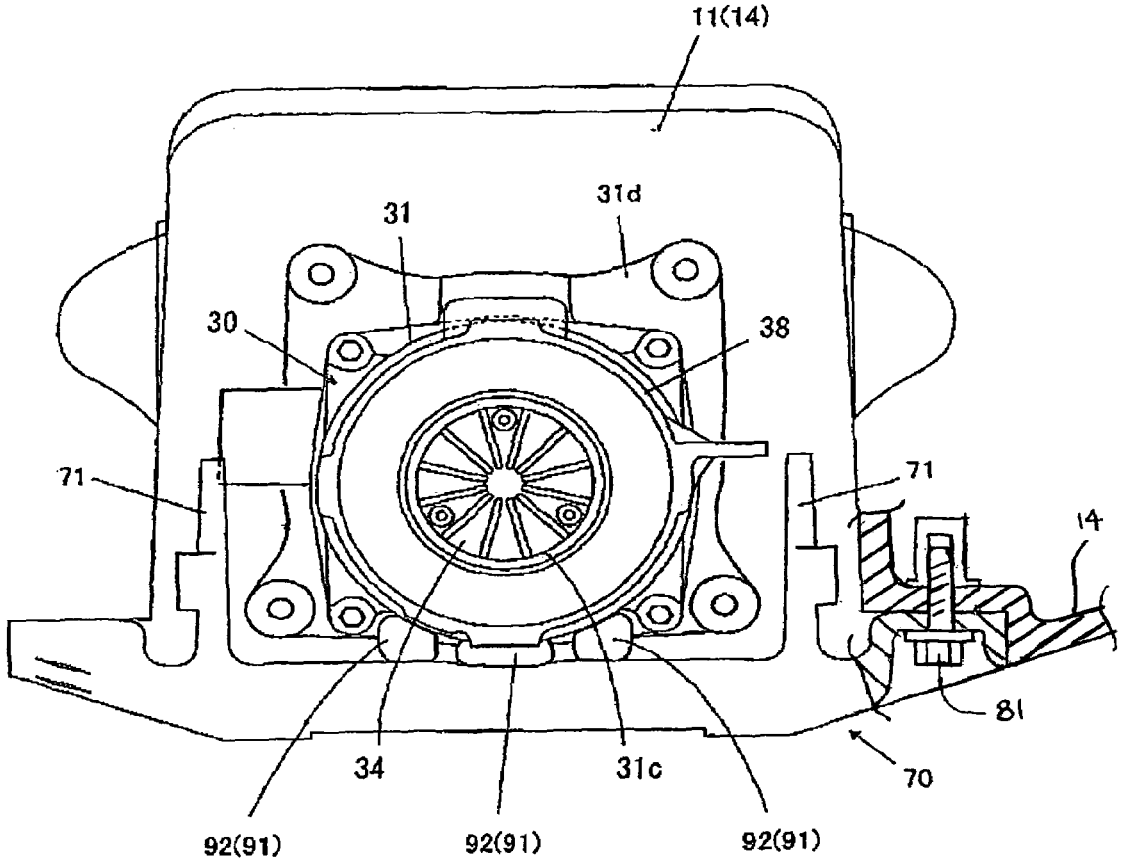
FIG. 4 is a view from arrow IV of FIG. 3.
Figure 5:
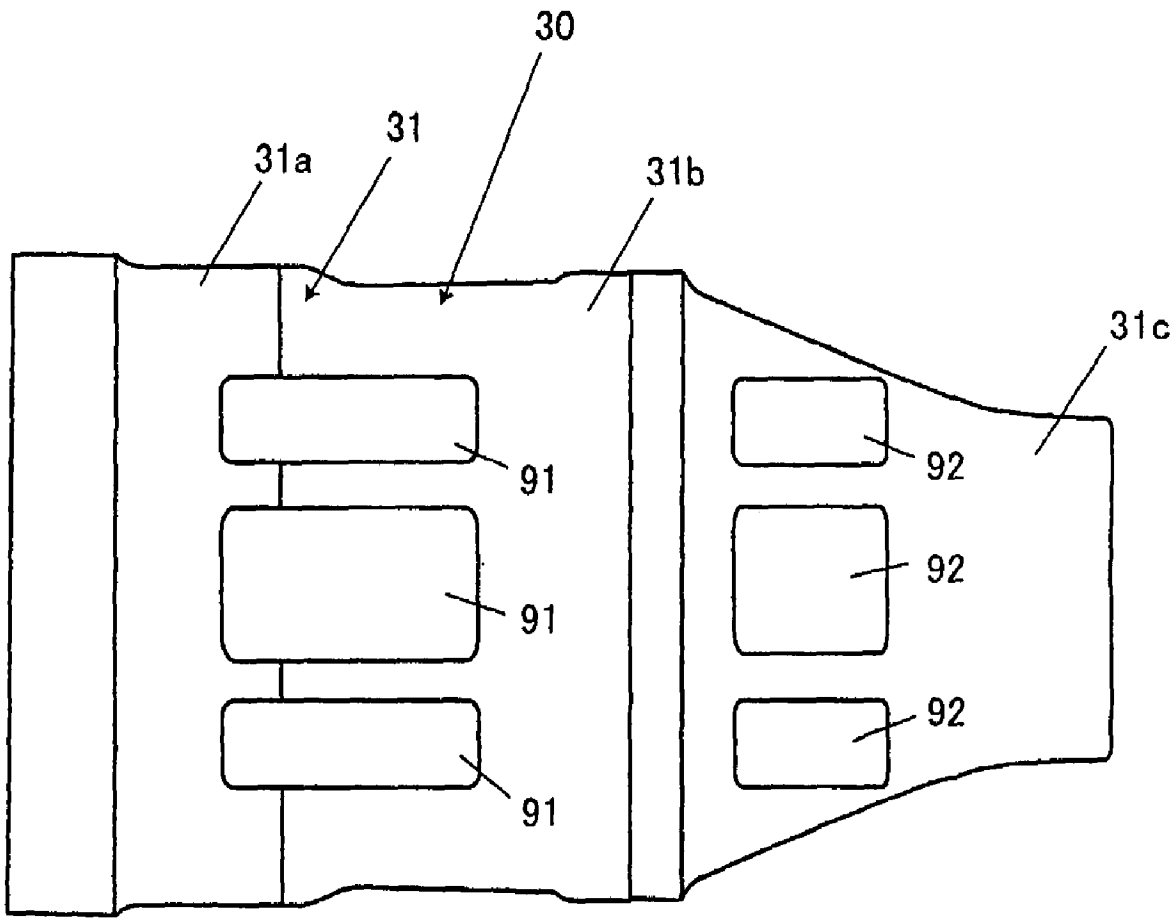
FIG. 5 is a partly omitted bottom view showing the mounting structure for the jet propulsion pump.

FIG. 3 is a cross-sectional view (partly omitted enlarged sectional view of FIG. 1) showing the mounting structure for the jet propulsion pump 30. FIG. 4 is a view from arrow IV of FIG. 3. FIG. 5 is a partly omitted bottom view.

As shown in these figures (mainly in FIG. 3), the jet propulsion pump 30 includes a hollow cylindrical housing (stator duct) 31 for forming the flow passage 18 communicated with the water intake port 17 (see FIG. 1) provided at a bottom portion of the watercraft body 11. Jet propulsion pump 30 also includes the impeller 32 disposed in the housing 31, an impeller bearing portion 33 provided in the housing 31, and a cap 34 for closing the rear end of the bearing portion 33.

The housing 31 includes an impeller containing portion 31*a*, a bearing containing portion 31*b*, and a nozzle portion 31*c*. The impeller containing portion 31*a* and the bearing containing portion 31*b* are formed as one watercraft body. The bearing portion 33 is integrally supported inside the bearing containing portion 31*b* through stationary blades 31*b*1.

A front portion of a boss portion 32*a* of the impeller 32 is engaged with splines 22*b* formed at the rear end of the drive shaft 22. The impeller 32 is rotated together with the drive shaft 22. A tip end portion of the drive shaft 22 is connected through the coupler 23 (FIG. 1) to the output shaft 21 of the engine 20 mounted on watercraft body 11 as above-mentioned.

On the other hand, an impeller shaft 35 for supporting a rear portion 32*b* of the boss portion 32*a* of the impeller 32 is rotatably (rotatably about its own axis) supported on the bearing portion 33 through front and rear bearing members (in the figure, ball bearings) 61, 62. The impeller shaft 35 is provided at its tip end with a male screw 35*a*, which is screw-engaged with a female screw formed at the boss portion rear portion 32*b* of the impeller 32, whereby the impeller 32 and the impeller shaft 35 are connected to each other.

Therefore, the impeller 32 is connected to the shaft 22 at the front portion of the boss portion 32*a* thereof and to the impeller shaft 35 at the rear portion 32*b* of the boss portion 32*a* thereof, and is rotated together with the shaft 22 and the impeller shaft 35.

With the drive shaft 22 driven by the engine 20 as above-mentioned, the impeller 32 is driven to rotate, and a water flow is jetted rearward, whereby the watercraft body 11 is propelled forward.

The jet propulsion pump 30 as described above is detachably fixed to the hull 14 by a structure in which a flange portion 31*d* provided at a front portion of the housing 31 is fixed to the hull 14 by bolts (not shown).

In addition, a ride plate 70 is provided beneath (on the lower side of) the jet propulsion pump 30.

The ride plate 70 is fixed to the watercraft body (hull 14) by bolts 80, 81 at a total of four positions, i.e., at two positions in the planing direction of the watercraft body (the left-right direction in FIG. 3) and at two positions in the width direction (the direction orthogonal to the paper surface of FIG. 3), and a left-right pair of arms (only one of them is shown in FIG. 3) 71 provided integrally with the ride plate 70 in the range from an intermediate portion toward the upper rear side are fixed to side surfaces 14*a* (see FIG. 2) of the hull 14 by bolts (not shown) passed through bolt holes 72, 73 formed therein.

Elastic members (for example, rubber, synthetic resin, springs, etc.) 91, 92 are disposed between the ride plate 70 and the jet propulsion pump 30, and a rear portion of the jet propulsion pump 30 is supported by the ride plate 70 through the elastic members.

In FIG. 3, two elastic members 91 and 92 are arranged at relative front and rear positions, but only one of them is required.

The mounting structure for the jet propulsion pump in the personal watercraft as above-described is a mounting structure for a jet propulsion engine in a personal water craft including the watercraft body 11, the jet propulsion pump 30, of which a front portion is fixed to a rear portion in the planing direction of the watercraft body 11, and the ride plate 70 fixed to the watercraft body 11 so as to be located beneath the jet propulsion pump 30, wherein the ride plate 70 is fixed to the watercraft body 11 at least two positions in the planing direction of the watercraft body 11. The elastic member(s) 91 and/or 92 is disposed between the ride plate 70 and the jet propulsion pump 30, and a rear portion of the jet propulsion pump 30 is supported by the ride plate 70 through the elastic member(s). Therefore, this mounting structure provides the functions or effects described below.

The jet propulsion pump 30 is firmly mounted to the watercraft body 11 by the structure in which the front portion 31*d* thereof is fixed to a rear portion, in the planing direction, of the watercraft body 11. The rear portion (the portion on the rear side relative to the front portion 31*d*) thereof is supported by the ride plate 70 through the elastic member(s), and the ride plate 70 is fixed to the watercraft body 11 in at least two positions in the planing direction of the watercraft body 11. As a result, the jet propulsion pump 30 is firmly mounted to the watercraft body 11 in a both end supported condition.

In addition, the rear portion of the jet propulsion pump 30 is not fixed to the ride plate 70 by bolts or the like but is elastically supported through the elastic member(s) 91 and/or 92, so that, if only the jet propulsion pump front portion mounting portion 14*b* (see FIG. 3) of the watercraft body 11 and the front portion 31*d* of the jet propulsion pump 30 are produced with high accuracy, the jet propulsion pump 30 will be mounted in an appropriate position. Therefore, there is no need for the above-mentioned adjusting operation using shims or the like, and the jet propulsion pump 30 can be easily mounted in the appropriate position.

Moreover, since the elastic member(s) is interposed between the ride plate 70 and the jet propulsion pump 30, it is possible to alleviate the influence, on the jet propulsion pump 30, of the shock due to the vigorous collisions of water against the ride plate 70.

If the rear portion of the jet propulsion pump 30 is fixed to the ride plate 70 by bolts or the like as above-mentioned, the shock at the time of vigorous collisions of water against the ride plate 70 would be exerted, nearly as it is, on the jet propulsion pump 30, causing bad influences on the durability of the jet propulsion pump 30, and the like. On the other hand, according to the structure of the present embodiment, notwithstanding that the jet propulsion pump 30 is supported by the ride plate 70, the shock upon vigorous collision of water against the ride plate 70 is alleviated before being transmitted to the jet propulsion pump 30, so that there is no possibility that the durability of the jet propulsion pump 30 might be decreased.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. A mounting structure for mounting a jet propulsion pump in a body of a personal watercraft wherein the jet propulsion pump is mounted aft of an engine driving the jet propulsion pump, said mounting structure comprising:

a front mounting portion of said pump having a flange mounted directly to a rear portion, in a planing direction, of the watercraft body;

a ride plate mounted to the watercraft body, so as to be located beneath said pump, wherein said ride plate is mounted to the watercraft body in at least two positions in the planing direction of the watercraft body, and wherein said ride plate extends from a location in front of said pump to a location behind said pump, in the planing direction of the watercraft; and an elastic member disposed between said ride plate and said pump, such that a rear portion of said pump is supported by said ride plate through said elastic member.

2. The mounting structure of claim 1, wherein there are a plurality of elastic members disposed between said ride plate and said pump.

3. The mounting structure of claim 2, wherein said plurality of elastic members include elastic members spaced apart in the planing direction.

4. The mounting structure of claim 2, wherein said plurality of elastic members include elastic members spaced apart in a width direction of the watercraft.

5. The mounting structure of claim 2, wherein said plurality of elastic members include two rows of three elastic members, said rows being spaced apart in the planing direction.

6. The mounting structure of claim 1, wherein said ride plate is mounted to said watercraft body in at least four positions.

7. The mounting structure of claim 6, wherein said ride plate is mounted to said watercraft body by bolts.

8. The mounting structure of claim 1, wherein said ride plate includes a pair of upwardly extending arms disposed on opposite sides of said ride plate, wherein each arm is mounted to a cooperative surface of said watercraft body.

9. A mounting structure for mounting a jet propulsion pump in a body of a personal watercraft wherein the jet propulsion pump is mounted aft of an engine driving the jet propulsion pump, said mounting structure, comprising:

a front mounting flange portion of said pump being bolted directly to a rear portion, in a planning direction, of the water craft body;

a ride plate mounted to the watercraft body, so as to be located beneath said pump, wherein said ride plate is mounted to the watercraft body by four bolts, at least two of which are spaced apart in the planning direction of the watercraft; and a plurality of elastic members disposed between said ride plate and said pump, wherein said elastic members are disposed in at least two rows, which are spaced apart in the planing direction, such that a rear portion of said pump is supported by said ride plate through said elastic members.

10. The mounting structure of claim 9, wherein said ride plate extends from a location in front of said pump to a location behind said pump, in the planing direction of the watercraft.

11. The mounting structure of claim 9, wherein said ride plate includes a pair of upwardly extending arms disposed on opposite sides of said ride plate, wherein each arm is mounted to a cooperative surface of said watercraft body.

12. A personal watercraft having an engine driving a jet propulsion pump mounted aft of the engine, comprising:

a mounting structure for mounting a jet propulsion pump in a body of the personal watercraft, comprising:

a front mounting portion of said pump being mounted directly to a rear portion, in a planing direction, of the watercraft body;

a ride plate mounted to the watercraft body, so as to be located beneath said pump, wherein said ride plate is mounted to the watercraft body in at least two positions in the planing direction of the watercraft body; and an elastic member disposed between said ride plate and said pump, such that a rear portion of said pump is supported by said ride plate through said elastic member.

13. The personal watercraft of claim 12, wherein said front mounting portion of said pump is a flange which is cooperatively engageable with the rear portion of the watercraft body.

14. The personal watercraft of claim 12, wherein there are a plurality of elastic members disposed between said ride plate and said pump.

15. The personal watercraft of claim 14, wherein said plurality of elastic members include two rows of three elastic members, said rows being spaced apart in the planing direction.

16. The personal watercraft of claim 12, wherein said ride plate is mounted to said watercraft body in at least four positions.

17. The personal watercraft of claim 12, wherein said ride plate extends from a location in front of said pump to a location behind said pump, in the planing direction of the watercraft.

18. The personal watercraft of claim 12, wherein said ride plate includes a pair of upwardly extending arms disposed on opposite sides of said ride plate, wherein each arm is mounted to a cooperative surface of said watercraft body.

19. The mounting structure of claim 1, wherein said ride plate is mounted to the watercraft body by at least a pair of bolts, disposed on opposite sides of the said jet propulsion pump in a width direction of the watercraft.

* * * * *